US007270358B2

(12) United States Patent
Hirsch

(10) Patent No.: US 7,270,358 B2
(45) Date of Patent: Sep. 18, 2007

(54) DEVICE FOR CARRYING OBJECTS

(75) Inventor: Jessica Hirsch, New York, NY (US)

(73) Assignee: Octopus New York, Inc., New York, NY (US)

( * ) Notice: Subject to any disclaimer, the term of this patent is extended or adjusted under 35 U.S.C. 154(b) by 0 days.

(21) Appl. No.: 11/442,121

(22) Filed: May 30, 2006

(65) Prior Publication Data

US 2006/0208516 A1 Sep. 21, 2006

(51) Int. Cl.
*A45F 5/00* (2006.01)

(52) U.S. Cl. ..... 294/157; 294/148

(58) Field of Classification Search ..... 294/138, 294/146, 148, 150, 152, 157, 165; 224/627, 224/650, 651, 658, 259
See application file for complete search history.

(56) References Cited

U.S. PATENT DOCUMENTS 2,723,067 A * 11/1955 Fretz ..... 294/152
3,923,222 A * 12/1975 Groves ..... 294/157
5,251,945 A * 10/1993 Stoops ..... 294/152
5,407,110 A * 4/1995 Marsh, Jr. ..... 224/148.6
5,409,282 A * 4/1995 Bale ..... 294/152
5,622,346 A * 4/1997 Story, Jr. ..... 248/311.2
6,000,591 A * 12/1999 Alexander ..... 224/257
6,085,370 A * 7/2000 Lobascio ..... 5/510
6,193,293 B1 * 2/2001 Ybanez ..... 294/152

* cited by examiner

*Primary Examiner*—Dean J. Kramer
(74) *Attorney, Agent, or Firm*—Birch, Stewart, Kolasch & Birch, LLP

(57) ABSTRACT

A carrying device may include for example two main loops or straps connected at for example four connection points, to hold objects, for example rectangular objects. Other numbers of straps or loops may be used, and other connection points may be used. A first loop may form both a holder for the object and a set of handles or shoulder straps for a user, and a second loop or strap may stabilize or hold the object in the holder, for example preventing significant horizontal movement.

21 Claims, 5 Drawing Sheets

DEVICE FOR CARRYING OBJECTS

This application claims priority under 35 U.S.C. § 120 of parent application Ser. No. 10/939,520 filed Sep. 14, 2004.

FIELD OF THE INVENTION

The present invention relates to the devices for carrying articles.

BACKGROUND OF THE INVENTION

Devices for carrying articles, such as backpacks, nets, handbags, etc. are known. However, present devices are not capable of efficiently and easily carrying certain articles of a moderately bulky size and shape, while at the same time being themselves compact, lightweight, adjustable, and easy to use. For example, large file folders, (e.g., Redweld.™ folders), often used to carry legal documents, are relatively bulky and may be too big or oddly sized to be carried in, for example, a purse or shoulder bag. The same may be said for other objects such as laptop computers, oversized books, art portfolios, etc. While such objects may be carried in specialized cases such as laptop cases, legal briefcases, other briefcases, portfolios, etc., or other holders, these holders themselves may be heavy and bulky, and further may not compress or store easily.

SUMMARY OF THE INVENTION

In one embodiment of the present invention, a carrying device may include two main loops, strips or straps connected at for example four connection points, to hold objects, for example rectangular objects. Other numbers of straps or loops may be used, and other numbers of connection points may be used. A first loop may form both a holder for the object and a set of handles or shoulder straps for a user, and a second loop or strap may stabilize or hold the object in the holder, for example preventing significant horizontal movement.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings in which:

Figure 1:
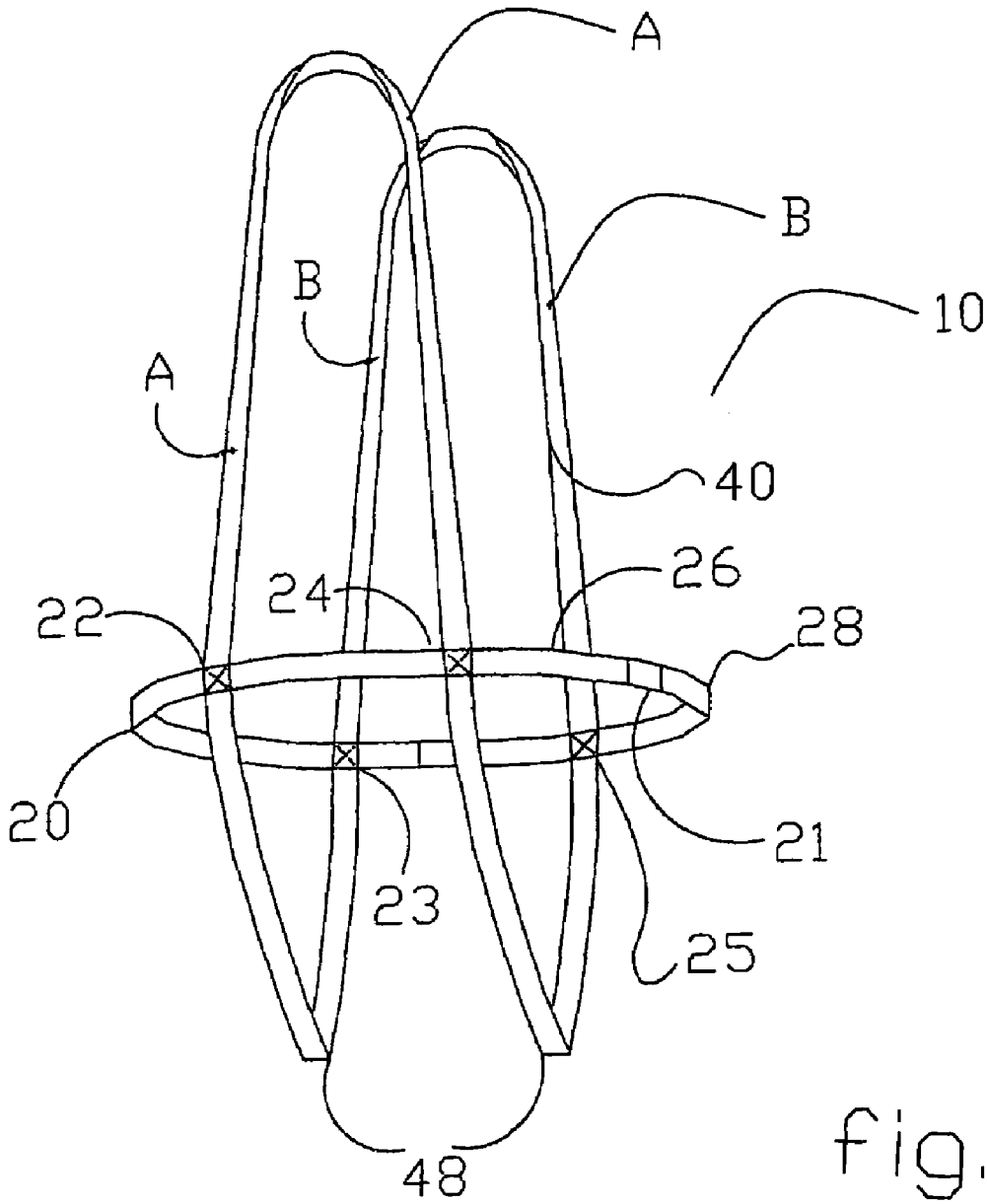
FIG. 1 depicts a carrying device according to one embodiment of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following description, various aspects of the invention will be described. For purposes of explanation, specific configurations and details are set forth in order to provide a thorough understanding of the invention. However, it will also be apparent to one skilled in the art that the invention may be practiced without the specific details presented herein. Furthermore, well known features may be omitted or simplified in order not to obscure the invention.

FIG. 1 depicts a carrying device according to one embodiment of the present invention. Referring to FIG. 1, carrying device 10 includes a first strip of material or strap 20 having a first end 26 and a second end 28, and a second strip of material or strap 40. In FIG. 1 first end 26 and second end 28 are shown connected by connection device 21, which may be located at one or both ends 26 and 28 of the strap 20 to connect and hold the ends. In one embodiment, first strap 20 is connected to second strap 40 at four connection points 22, 23, 24 and 25. In other embodiments, other configurations may be used, and other numbers and positions of connection points (for example, three or two, or another suitable number) may be used. Straps 20 and 40 may be connected at connection points 22, 23, 24 and 25 by, for example, sewing, heat or ultrasonic welding, glue, etc; alternately straps 20 and 40 may be one integral piece of, for example, plastic, nylon, fabric, etc. In one embodiment, strap 40 may be connected to strap 20 only on one surface A of the two surfaces A and B of strap 40; in other embodiments connection may be on other surfaces, or strap 40, if in another form, need not have flat surfaces (e.g., may be rounded rope or cord, a tube, etc.).

Connection device 21 may be, for example, a set of Velcro.™ brand hook and loop fasteners or pads, or other hook and loop fasteners (e.g., a hook pad and a loop pad), strips, snaps, buttons, hooks or loops, rings, a buckle into which one free end 26 or 28 may be inserted, a clamp, etc.

Strip of material or strap 40 may form both a holder for the object and a set of handles or shoulder straps for a user, and strip of material or strap 20 may stabilize or hold the object in the holder, for example preventing significant horizontal movement. Strap 40 may form a loop (e.g., loop 42 in FIG. 2) which itself may be folded back on itself to provide for example two holding portions, e.g. portions 48, to hold the object 12 at for example two points at the bottom of the object 12. Straps 20 and 40 may be connected so that, for example, strap 40 is divided into two half loops on one side of the strap 20 and into two half loops on a second side of strap 20. Typically, the connection points 22, 23, 24 and 25 are located on second strap 40 so that the second strap 40 is divided into an upper portion with two arcs and a lower portion with two arcs, such that the terminal ends of each upper arc pair are not paired themselves as terminal ends of the lower arcs, but rather each of the two terminal ends of an upper arc pair are the terminal end of a different lower arc pair. In one embodiment, the upper arcs are larger than the lower arcs. In other embodiments, other configurations may be used.

Figure 2:
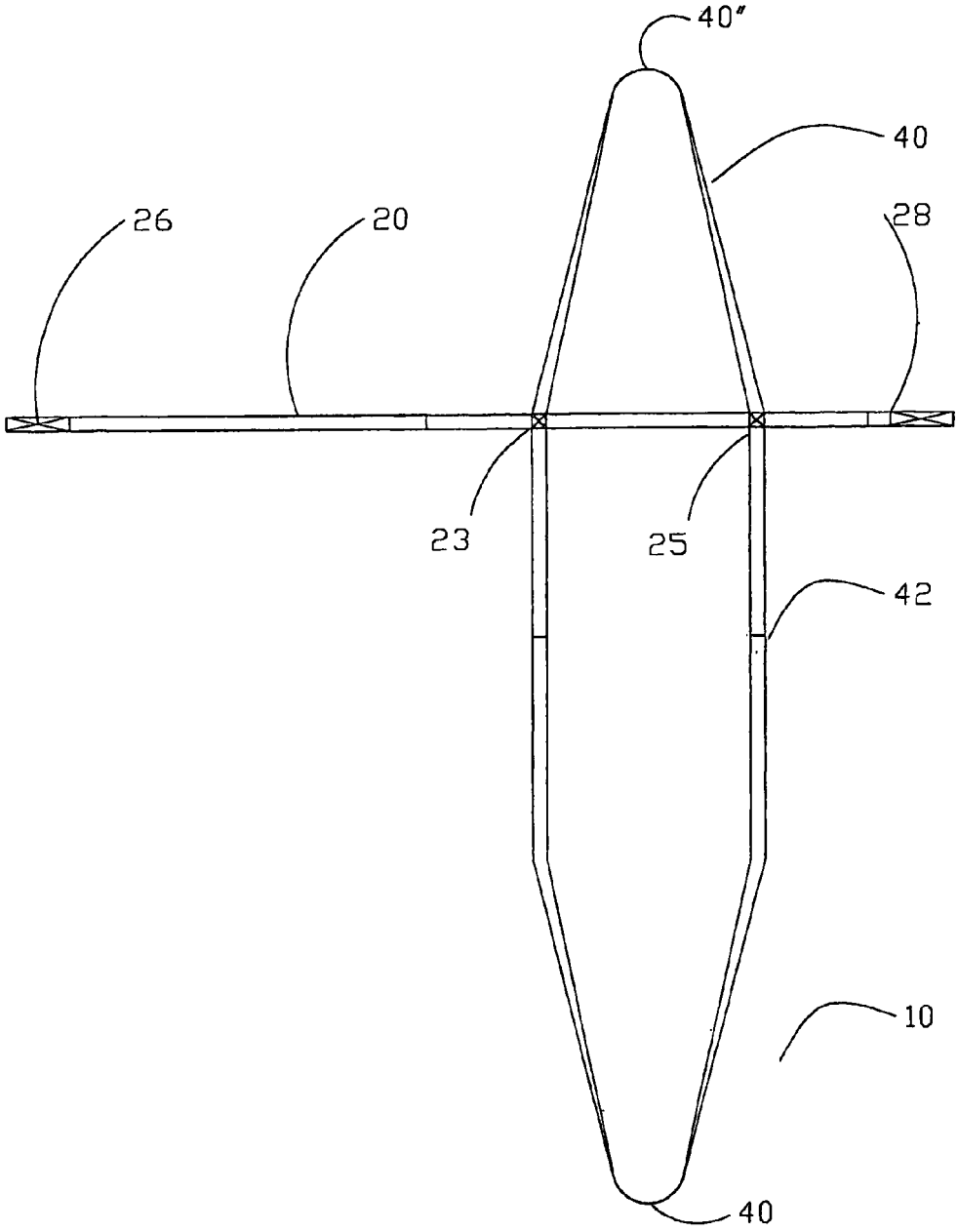
FIG. 2 depicts a carrying device open and flat, and not carrying an item, according to one embodiment of the present invention.

FIG. 2 depicts a carrying device open and flat, and not carrying an item, according to one embodiment of the present invention. Further, in FIG. 2, strips of material or straps 20 and 40 are shown with strap 20 open, connected to strap 40 at only two connection points 23 and 25 for clarity.

In other embodiments, straps 20 and 40 are connected via other than four (e.g., two) connection points; thus FIG. 2 shows in addition an alternate embodiment of device 10. In one embodiment, connection points 22, 23, 24 and 25 are within one half of the length (when elongated to a lengthwise loop) of the loop 42 formed by strap 40 when laid flat. In other embodiments, other configurations may be used, and other numbers and positions of connection points may be used. When the device 10 is not carrying an item, first strap 20 does not form a loop, and second strap 40 is looped, forming one loop 42. In one embodiment, if first strap 20 is connected to second strap 40 at two points, both connection points 23 and 25 are within one half of the length of first strap 20. Connection points 23 and 25 (and 23 and 24, if used) are within one half of the length (when elongated to a lengthwise loop) of the loop 42 formed by strap 40. In FIG. 2, strap 40 is showed elongated with two ends 40' and 40".

While first strap 20 is described as a strip or strap not forming a loop, first strap 20 may have other suitable structures, for example a straight piece formed of multiple pieces. While second strap 40 is described as being looped, second strap 40 may have other suitable structures, for example a loop of multiple pieces.

In FIG. 2 first strap 20 is shown extended and second strap 40 is shown elongated. Typically, when strap 20 is extended, at least one end 26 or 28, of first strap 20, and preferably both ends end 26 and 28, are free and are located some distance from second strap 40.

Figure 3:
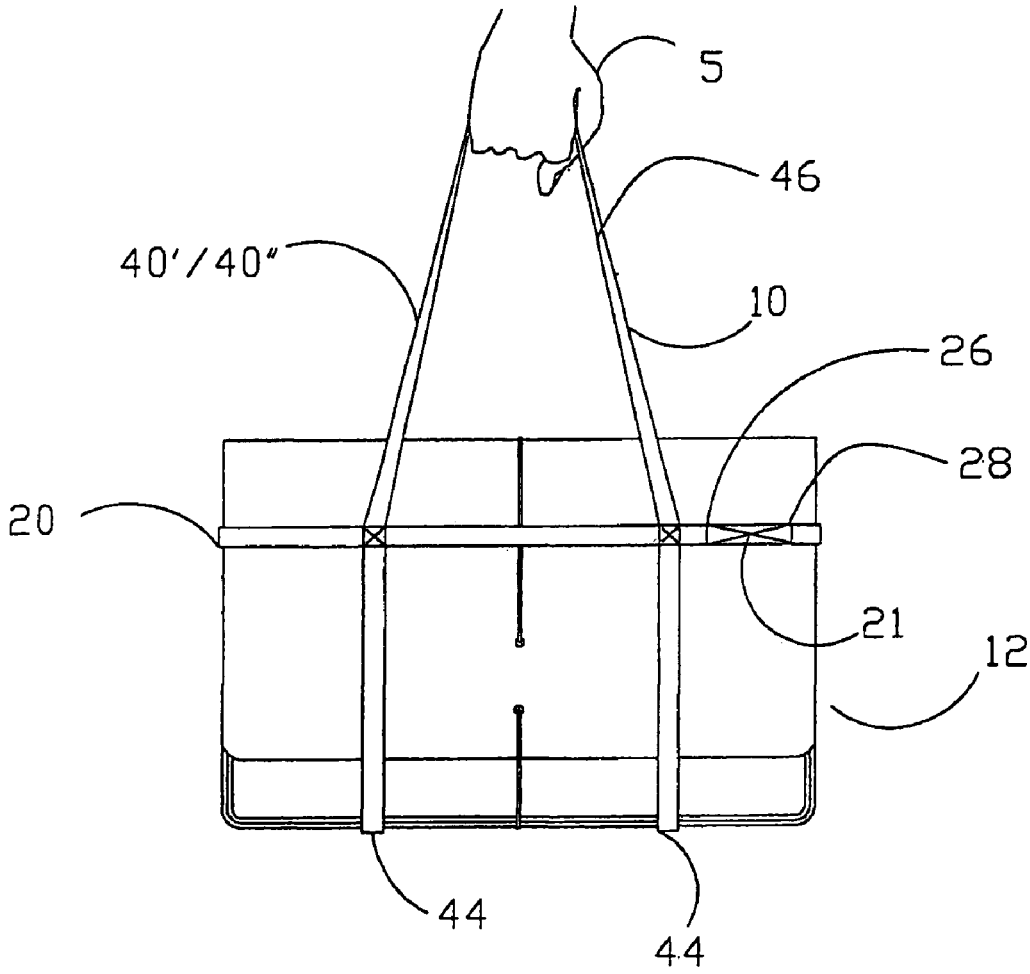
FIG. 3 depicts a carrying device when carrying an object, according to one embodiment of the invention.

FIG. 3 depicts a carrying device when carrying an object, according to one embodiment of the invention. In one embodiment, device 10 is used to carry a rectangular or square object 12, such as one or more file folders (e.g., a Redweld.™ folder, an accordion or expandable folder, a pocket folder) one or more books, a legal briefcase or other briefcase, an artist's portfolio, an electronic device such as a laptop personal computer, a set of documents, etc. In other embodiments, device 10 may carry other objects.

Referring to FIG. 3, a user 5 carries an object 12 using device 10. Device 10 may form a cage like structure, allowing viewing of the object, as opposed to carrying devices completely enclosing the object. Device 10 may also provide a substantially light and compact holding device, the use of which is flexible. While in FIG. 3 a user is shown carrying the object 12 by hand, the strap 40 may be carried in another manner, for example over the shoulder, if the length is appropriate. Second strap 40 is folded over so that the two ends 40' and 40" (FIG. 2) are near each other or together, and may form two handles 40' and 40", which may be combined or pressed together (e.g., by a hand) to form a handle 46. In other embodiments, an additional structure may be added to the two ends 40' and 40" to form a handle, such as a handle, a tube, a padding device, etc.; such additional device may connect the two ends 40' and 40". The bottom 44 of the folded loop 42 holds the bottom of the object 12, and the first strap 20 holds the object 12 keeping it within the device 10, and possibly holding multiple objects together, if for example object 12 is a stack of books, more than one folder, etc. An additional strap or supporting portion, for example parallel to strap 20, may be used. The ends 26 and 28 of the first strap 20 are connected, for example by connection device 21 or for example by tying, in which case no connector is needed.

Figure 4:
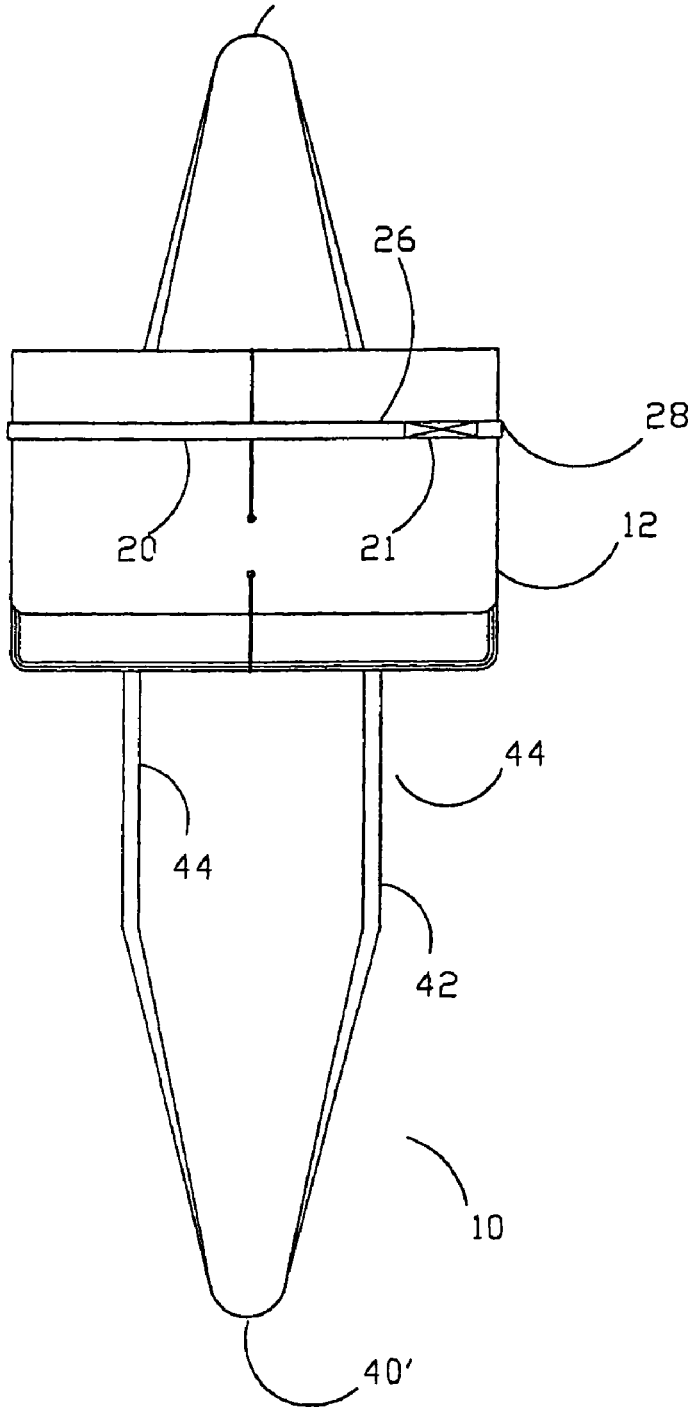
FIG. 4 depicts an object being placed in a carrying device, according to one embodiment of the invention.

FIG. 4 depicts an object being placed in a carrying device, according to one embodiment of the invention. Referring to FIG. 4, object 12 may be placed in the carrying device 10. Bottom 44 may be at this point merely straps or flat portions of second strap 40; when folded, bottom 44 may support the bottom of object 12. The ends 26 and 28 of the first strap 20 may be laid over the object 12 to hold the object 12 in the device 10. The ends 26 and 28 of the first strap 20 may be connected, attached, or tied by various known methods. After the object 12 is secured by strap 20, the second strap 40 may be folded over the object 12, so that the two ends 40' and 40" are near each other, touching, or connected. In an embodiment where strap 20 is connected to strap 40 in a different manner, such as via four connection points, an object may be placed in the carrying device in a different manner.

Typically, the first strap 20 is connected to the second strap 40 so that when the second strap 40 is folded so that two ends 40' and 40" of the elongated loop 42 meet, the first strap 20 is located somewhere between the two ends 40' and 40" (which touch or are near each other when the loop 42 is fully folded) and the bottom 44 of the folded loop. In one embodiment, the connection points 23 and 25 are located on second strap 40 so that when the second strap 40 is elongated, as in FIG. 2, connection points 23 and 25 are located about one third of the way from a second end 40" of second strap 40, and first strap 20 crosses second strap 40 at about one third the distance from a second end 40". In other embodiments, other distances may be used, for example, the connection points 23 and 25 are located on second strap 40 less than two fifths of the distance from a second end 40" to a first end 40'. Other connection locations may be used.

Figure 5:
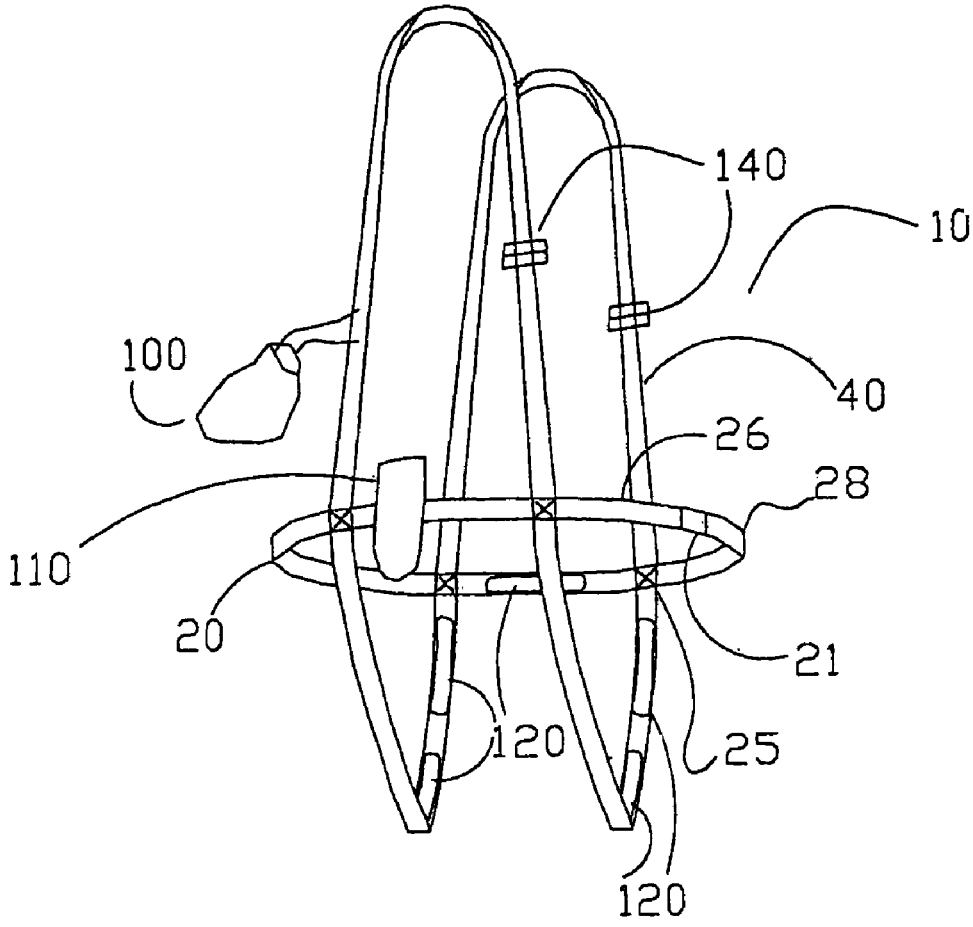
FIG. 5 depicts a device including additional functionality, according to some embodiments of the invention.

FIG. 5 depicts a device including additional functionality, according to some embodiments of the invention. In some embodiments, device. 10 is foldable. In one embodiment, device 10 may simply be balled up or folded into a compact space. A bag or sack may be used to enclose the balled up or folded device 10, and for example may be attached to a portion of the device 10; for example an optional bag 100 may be attached to a portion of device 10 and may be used to store device 10, an optional bag 100 may also store other objects (e.g., change, keys, etc.). Optional bag 100 may store device 10 at some times but may store other objects when device 10 is in use.

Device 10 may include structures for carrying other objects. For example, an optional holder 110 may be attached to a portion of device 10, for example to hold a cell phone, personal digital assistant, pens, money, keys, etc. In some embodiments, a portion of strap 20 or strap 40 may include optional padding 120; for example for holding an electronic device such as a personal computer. Strap 20 or strap 40 may include one or more adjustment buckles 140, for example to adjust the height of the handle portion or to adjust the width of the carrying portion by adjusting strap 20. Other additional structures or devices may be used.

Straps 20 and 40 may be, for example, suitable cotton, leather, polypropylene, nylon, plastic or other material, and may take the form of, for example, webbing, woven material, tape, etc. In one embodiment, strap 20 is elastic or stretchable or includes an elastic or stretchable portion, to adjust its size to an object and to snugly fit an object, and strap 40 is not elastic. In other embodiments strap 40 is elastic. While the components of a device according to the present invention may be made primarily from flat, wide, straplike material or strips, other components may be used, such as cord, ropes, rolled or partially rolled straps, or folded straps, etc. Further, different portions of a device according to an embodiment of the present invention may not need to be straplike. For example, only portions holding an object may be flat, for stability and to not mar the object, other portions, such as connecting portions or handles, may be not flat, e.g., may be folded over straps, ropes, round or tublelike structures, etc. In other embodiments, the entire portion of straps 20 or 40 may be non-flat.

It should be noted that although a portion of the discussion may relate to carrying certain objects such as folders, books, briefcases, and electronics equipment, the present invention is not limited in this regard, and embodiments of the present invention may be used to carry other suitable objects.

While certain features of the invention have been illustrated and described herein, many modifications, substitutions, changes, and equivalents may occur to those of ordinary skill in the art. It is, therefore, to be understood that the appended claims are intended to cover all such modifications and changes as fall within the true spirit of the invention.

The invention claimed is:

1. A carrying device for carrying one or more relatively bulky objects, comprising:

a first loop of relatively inelastic flexible strapping supporting the one or more relatively bulky objects and providing a carrying handle to the carrying device;

a second elastic loop of flexible strapping permanently attached to the first loop at least four connection points, the first loop of flexible material being divided into a first and a second half loop on a first side of the second loop and a third and a fourth half loop on a second side of the second loop;

wherein the length of the second loop between the connection points on the first half loop is greater than the length of the second loop between the connection points on the third half loop.

2. The device of claim 1, the second loop including first and second ends provided with a connection device for connection therebetween to selectively open said second loop.

3. The device of claim 2, wherein the connection device includes at least a set of hook and loop strips.

4. The device of claims 1 wherein that first and second loops are uninterrupted at least when said device is being used to carry objects.

5. The device of claim 2, wherein the connection device includes at least a set of snaps.

6. The device of claim 1, wherein the first and second half loops form handles and the third and fourth half loops support the object or objects.

7. The device of claim 6, wherein the first loop when used to carry an object or objects is folded back on itself to hold the object.

8. The device of claim 1, wherein a first end of the first half loop meets an end of the third half loop, and a second end of the first half loop meets an end of the fourth half loop.

9. The device of claim 1 wherein the device may be balled or folded into a size substantially smaller in all dimensions than its size during use.

10. A carrying device for carrying one or more relatively bulky objects, the carrying device including structure for holding and constraining the horizontal movement of the object or objects consisting essentially of:

a first loop of relatively inelastic flexible strapping supporting the one or more relatively bulky objects and providing a carrying handle to the carrying device;

a second elastic loop of flexible strapping permanently attached to the first loop at at least four connection points;

the first loop of flexible strapping is divided into a first and a second half loop on a first side of the second loop and a third and a fourth half loop on a second side of the second loop;

wherein the length of the second loop between the connection points on the first half loop is greater than the length of the second loop between the connection points on the third half loop.

11. The carrying device of claim 10 wherein said carrying device further includes a storage bag attached to one of said first and second loops.

12. The device of claim 10, the second loop including first and second ends provided with a connection device for connection therebetween to selectively open said second loop.

13. The device of claim 12, wherein the connection device includes a set of hook and loop pads.

14. The device of claims 10 wherein that first and second loops are uninterrupted at least when said device is being used to carry objects.

15. The device of claim 10, wherein the first and second half loops form handles and the third and fourth half loops support the object or objects.

16. The device of claim 15, wherein the first loop when used to carry an object or objects is folded back on itself to hold the object.

17. The device of claim 10, wherein a first end of the first half loop meets an end of the third half loop, and a second end of the first half loop meets an end of the fourth half loop.

18. The device of claim 10 wherein the device may be balled or folded into a size substantially smaller in all dimensions than its size during use.

19. A method of carrying one or more relatively bulky objects comprising;

providing a first loop of relatively inelastic flexible strapping permanently attached to a second elastic loop of flexible strapping at at least four connection points;

supporting the one or more relatively bulky objects solely with said first loop folded back on itself to hold the one or more bulky objects at two points;

using the first loop as a handle to carry the one or more bulky objects;

preventing horizontal movement of the one or more bulky objects by encircling them with said second elastic loop;

the first loop of flexible strapping is divided into a first and a second half loop on a first side of the second loop and a third and a fourth half loop on a second side of the second loop; and wherein the length of the second loop between the connection points on the first half loop is greater than the length of the second loop between the connection points on the third half loop.

20. The method of claim 19 wherein said method further includes:

providing first and second ends in the second loop and a connection device for connection therebetween, and selectively opening said second loop to ease loading the one or more bulky objects into the first and second loops to facilitate said steps of supporting and preventing horizontal movement.

21. The method of claim 19 wherein said method is for carrying file folders, legal briefcases, artists' portfolios, or legal documents.

* * * * *